United States Patent [19]

Vetter

[11] 3,982,596

[45] Sept. 28, 1976

[54] DRILL BIT

[75] Inventor: Vincent Hugo Vetter, Midland, Tex.

[73] Assignee: Smith International, Inc., Midland, Tex.

[22] Filed: Dec. 30, 1974

[21] Appl. No.: 537,438

[52] U.S. Cl. ..... 175/410; 175/215; 175/404; 175/412; 175/418

[51] Int. Cl.[2] ..... E21C 13/00

[58] Field of Search ..... 175/400, 410, 412, 406, 175/407, 413, 330, 405, 404

[56] References Cited

UNITED STATES PATENTS

| | | | |
|---|---|---|---|
| 1,547,461 | 7/1925 | Steele | 175/215 X |
| 2,708,105 | 5/1955 | Williams | 175/400 |
| 2,708,566 | 5/1955 | Caldwell | 175/312 X |
| 3,269,470 | 8/1966 | Kelly | 175/410 |
| 3,389,761 | 6/1968 | Ott | 175/410 X |
| 3,471,177 | 10/1968 | Garrett et al. | 285/133 |
| 3,628,616 | 12/1971 | Neilson | 175/410 X |
| 3,640,352 | 2/1972 | Stuart | 175/404 X |

*Primary Examiner*—Ernest R. Purser
*Assistant Examiner*—Richard E. Favreau
*Attorney, Agent, or Firm*—Murray Robinson

[57] ABSTRACT

A rotary percussion bit comprises a body having at its upper end a threaded pin adapted to mate with a length of dual conduit drill stem. A plurality of down flow passages for air or other drilling fluid are near the periphery of the body. Inwardly of the down flow passages is an upflow passage. Channels across the lower face of the body connect the down flow and upflow passages. Over the bottom face of the body are located interior boring elements. The face is preferably concave, comprising a plurality of annular steps. At the lower end of the body is disposed a ring on the flat bottom of which are located gage and near gage boring elements. The ring extends down below the outer periphery of the bottom face of the body of the bit. The ring is secured to the body by quick attachable and detachable means in the form of an epoxy cemented straight threaded rotary shouldered connection, the ring having a bevelled lip extending upwardly around the bit body. The outer peripheries of the lip and ring are protected by wear resistant material, which may be hard weld metal or flat ended tungsten carbide inserts. Preferably the boring elements of the body and ring are tungsten carbide inserts.

14 Claims, 4 Drawing Figures

DRILL BIT

BACKGROUND OF THE INVENTION

This invention pertains to bits used for boring holes in the earth and more particularly to such bits use in rotary percussion drilling with dual conduit drill stem. In such a system air or other drilling fluid flows down the outer conduit of the drill stem, through down fluid passages in the bit body, across the bottom of the bit and hole being bored, and back up the inner conduit of the drill pipe, carrying with it the detritus. The bit is both rotated and vibrated up and down by means connected to the upper end of the drill stem. The system is especially useful for drilling holes in permafrost to receive foundation members, e.g. to support an elevated fluid transmission pipe line. In such use the drill stem may comprise two lengths of drill pipe, one thirty-five feet long and the other fifteen feet long and the drill rig will be adapted to push the drill stem down as well as to rotate and vibrate it.

Conventional bits used in rotary percussion drilling wear out rapidly, whereupon it is necessary to replace the whole bit.

SUMMARY OF THE INVENTION

According to the invention, a rotary percussion bit comprises a body having at its upper end a threaded pin adapted to mate with a length of dual conduit drill stem. A plurality of down flow passages for air or other drilling fluid are near the periphery of the body. Inwardly of the down flow passages is an upflow passage. Channels across the lower face of the body connect the down flow and upflow passages. Over the bottom face of the body are located interior boring elements. The face is preferably concave, comprising a plurality of annular steps. At the lower end of the body is disposed a ring on the flat bottom of which are located gage and near gage boring elements. The outer periphery of the ring is close to full gage to block flow therepast. The ring extends down below the outer periphery of the bottom face of the body of the bit. The ring is secured to the body by quick attachable and detachable means in the form of an epoxy cemented straight threaded rotary shouldered connection, the ring having a beveled lip extending upwardly around the bit body. The outer peripheries of the lip and ring are protected by wear resistant material, which may be hard weld metal or flat ended tungsten carbide inserts. Preferably the boring elements of the body and ring are tungsten carbide inserts. When the ring wears out it is easily removed and replaced to provide new gage boring elements and a new near full gage flow blocking outer periphery.

BRIEF DESCRIPTION OF THE DRAWING

For a detailed description of a preferred embodiment of the invention reference will now be made to the accompanying drawings wherein.

DESCRIPTION OF THE PREFERRED EMBODIMENT

Figure 1:
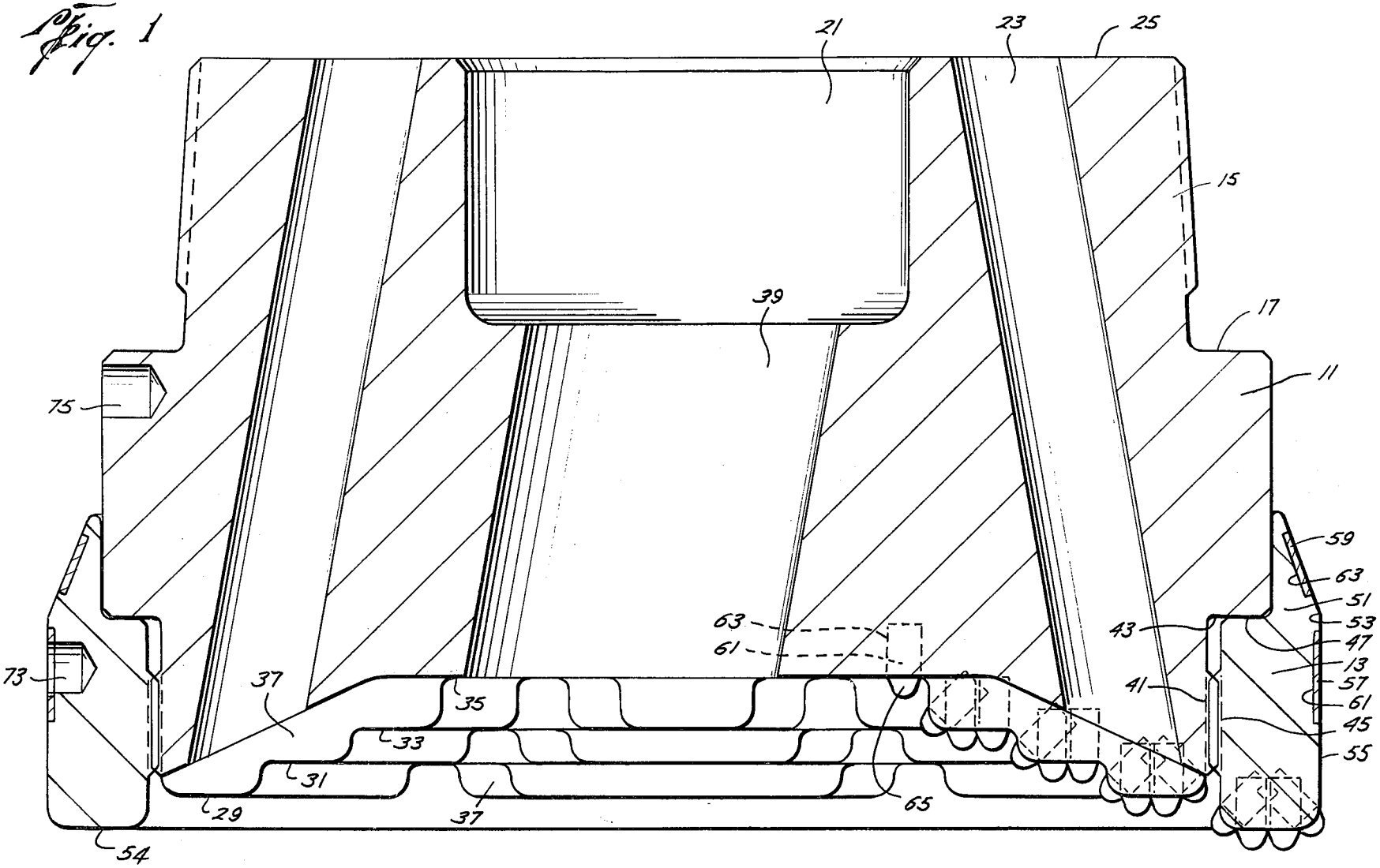
FIG. 1 is a vertical section through a bit embodying the invention.
Figure 2:
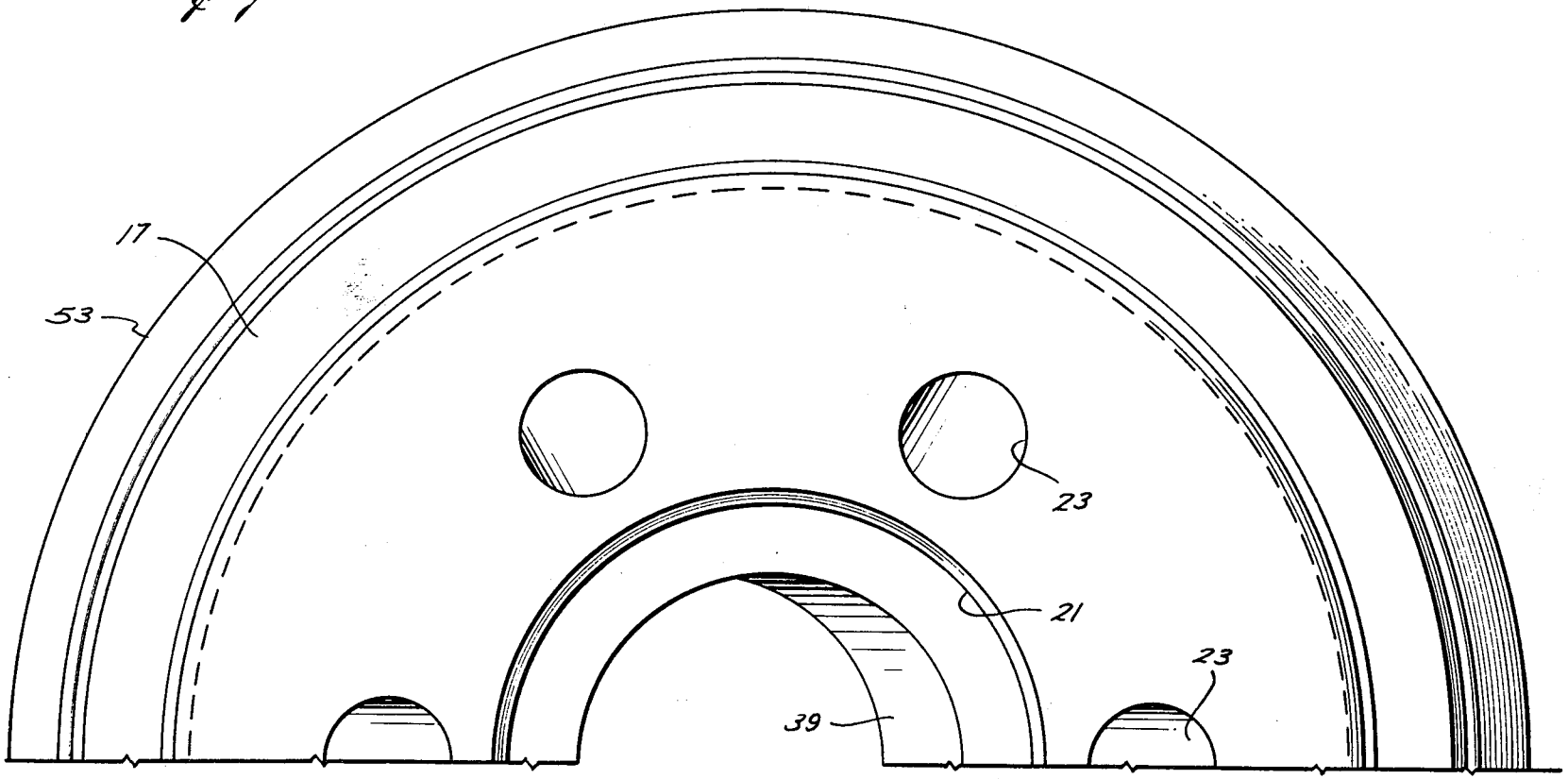
FIG. 2 is a top plan view of the bit shown in FIG. 1.

Referring now to the drawings, especially FIG. 1, there is shown a bit comprising a body 11 and a replaceable gage ring 13. At the upper end of the body there is a conical threaded pin 15 and square shoulder 17 axially spaced therebelow, providing means for making a rotary shouldered sealed connection with a correlative threaded box at the lower end of a dual conduit drill stem. Also at the upper end of the body there is a cylindrical box 21 adapted to make a sealed connection with a pin at the lower end of a dual conduit drill stem.

A plurality of down flow passages 23 surround box 21 and extend downwardly and outwardly from the upper flat face 25 of the bit body to the lower face thereof. The lower face is generally concave, being formed of a plurality of annular steps or lands 29, 31, 33, 35 of decreasing axial extent.

The downflow passages 23 connect at their lower ends (see FIG. 3) with radial channels 37 which extend transversely across the steps 29, 31 and 33 and empty onto step 35. A canted upflow passage 39 connects the space adjacent step 35 with box 21.

The bit body 11 is provided at its lower end with a straight threaded pin 41 and a square (90 degree) shoulder 43 axially spaced therefrom for making a rotary shouldered connection with a correlative straight threaded box 45 and square shoulder 47 on gage ring 13. A single lead thread with two threads per inch is suitable for the pin 41 and box 45.

Gage ring 13 has a collar or lip 51 extending upwardly around bit body 11 above shoulders 43, 47. This protects shoulders 43, 47 during use. The lip is conically bevelled at 53 forming a guide to facilitate withdrawal of the bit from the hole being bored. The outer periphery 55 of ring 13 is cylindrical and close to full gage, that is, its diameter is close to that of the hole being bored, thereby to restrict flow of air and detritus up around the outside of the bit. The lower face 54 of the gage ring is flat, providing a further annular step at the outer periphery of the bit. The gage ring extends axially below the outermost step 29 on the bit body and closes off the ends of radial channels 37.

The cylindrical outer peripheral surface 55 of ring 13 and the conically bevelled surface 53 of lip 51 are provided with wear resistant means such as bands 57, 59 of hard metal weld dsposited in annular grooves 61, 63. Alternatively, cylindrical tungsten carbide pellets with flat ends could be inserted into cylindrical holes in surfaces 53, 55.

Figures 3, 4:
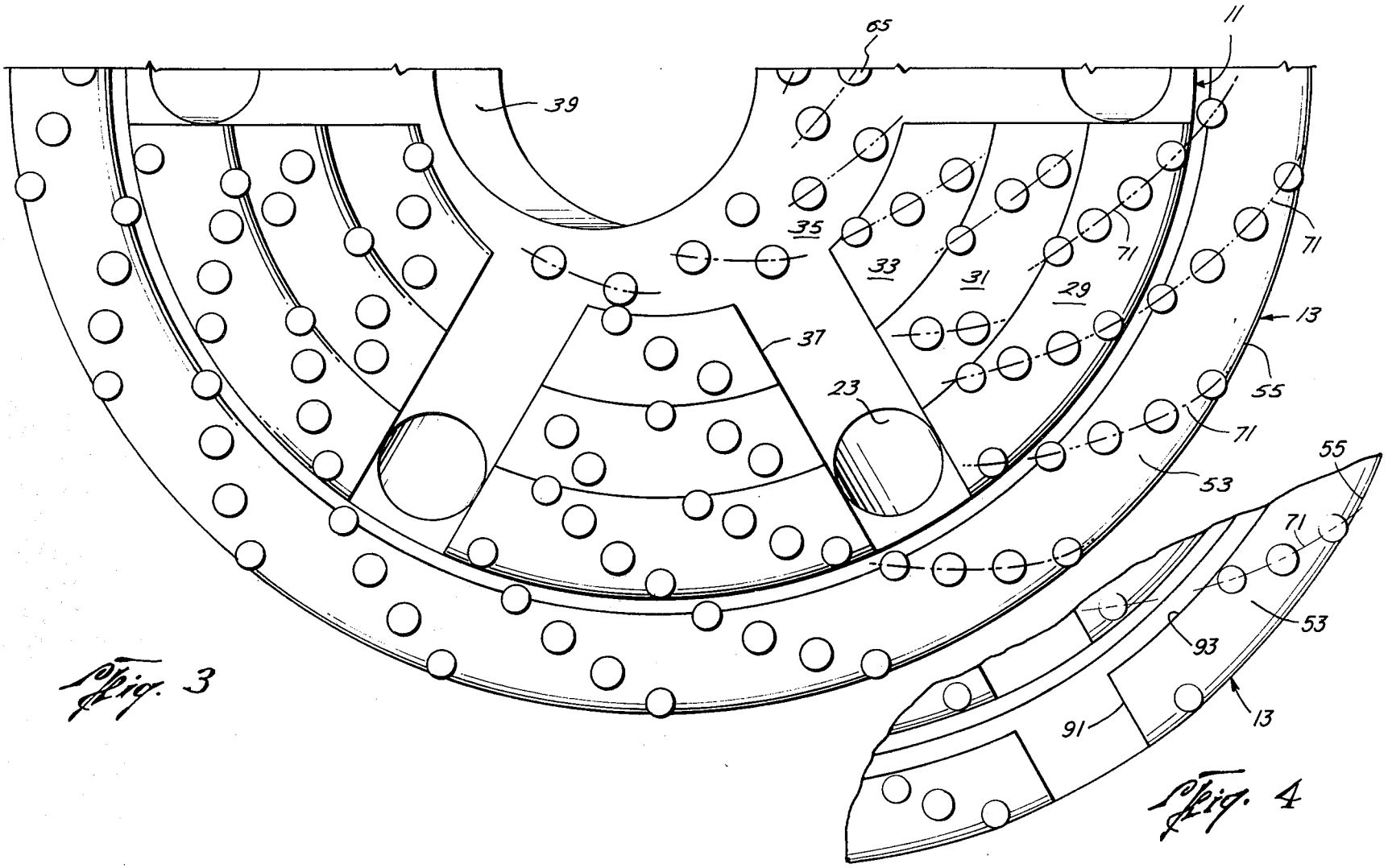
FIG. 3 is a bottom view of the bit shown in FIG. 1.
FIG. 4 is a fragmentary bottom view similar to FIG. 3 showing a modification.

The steps 29, 31, 33 and 35 at the bottom of the bit body and the step 53 provided by the flat bottom face of gage ring 13 are provided with suitable patterns of boring elements. Preferably the boring elements are cylindrical tungsten carbide pellets such as 61 inserted in cylindrical holes 63 in the steps, the protroding ends 65 of the pellets being rounded. As shown in FIG. 3 the boring element pattern comprises a plurality of spiral rows of pellets extending across the steps, as indicated by the broken lines 71, with the pellets nearest the edges of the steps canted away from the step, the others being perpendicular thereto. The pellets may be secured in place by any suitable means, e.g. a press fit.

Ring 13 and bit body 11 are provided with spanner wrench holes 73, 75, respectively, to assist in making and breaking the rotary shouldered connection there-between. Preferably epoxy cement is applied to the connection prior to make up. When it is desired to break the connection it is first heated to release the cement.

It will be apparent from the foregoing description of the bit that the boring elements 61 in the ring, being at the outer perimeter of the bit, travel farthest as the bit rotates. In addition, the outermost pellets are always in contact with the side of the hole being bored while the others merely vibrate down and up towards and away from the bottom of the hole, in and out of full contact therewith. Perhaps for these reasons, and others, the gage boring elements wear out first. When they wear out, it is only necessary to replace the gage ring while saving the much larger bit body for further use.

While a preferred embodiment of the invention has been shown and described, modifications thereof can be made by one skilled in the art without departing from the spirit of the invention. For example, instead of a concave, stepped bottom, the bit could be flat bottomed, or a convex stepped bottom could be employed.

Although it is known that multiple part drill bits of various types have been disclosed heretofore, such as in U.S. Pat. No. 1,907,154 to Mitchell, no claim is made for that type of construction which is for a core drill. It is also true that percussion bits with tungsten carbide inserts and radial flow channels are known as shown in U.S. Pat. No. 3,346,060 to Beyer, but Beyer does not show a replaceable gage ring. A rotary percussion bit with a concave stepped bottom face is shown in FIG. 7A of U.S. Pat. No. 3,269,470 to Kelly, but Kelly does not show a replaceable gage ring. It is also known to use epoxy cement as part of a releasable threaded connection for dual conduit drill stem as shown in U.S. Pat. No. 3,471,177 to Garrett et al. It is also known to seal a dual conduit bit to the side of a bore hole and to bond a bit head to a full gage bit shank as shown in U.S. Pat. No. Re. 26,669 to Henderson, but this does not appear to be a quick attachable and detachable connection and the whole bit head is removed, not just a gage ring. In U.S. Pat. No. 1,547,461 to Steele there is shown a dual conduit core bit employing detachable teeth, but here again there is no removable gage ring.

Although the invention has been described in connection with a dual flow passage reverse circulation percussion bit, the invention can, as shown in FIG. 4, be adapted to a single flow passage direct circulation bit by providing radial channels 91 across the bottom of the ring communicating via annular channel 93 with the radial channels 37 on the bottom of the bit body. If the channels 91 are manufactured to register with channels 37, the channel 93 can be omitted. In these single flow passage direct circulation constructions the down flow passages 23 would be omitted. Another modification would be to substitute roller cones with tungsten carbide inserts for the fixed carbide inserts, but still employing the fixed inserts in the gage ring. The roller cones could be similar to those shown in U.S. Pat. No. 3,416,618 to Kunneman. Such roller cone and gage ring construction could be of either the direct circulation single flow passage or the reverse circulation dual flow passage type as previously discussed for the bit body having fixed boring elements.

In all of the various embodiments of the invention the gage ring also provides a convenient means to change bit diameter by simply substituting a gage ring of the desired size. Also, in all of the dual flow passage reverse circulation constructions, the gage ring can function to seal between the bit bore wall, thereby to prevent upflow of fluid and detritus from the hole bottom up past the bit into the hole annulus around the drill pipe. In all forms of the invention the gage ring can be replaced when worn out, while retaining the bit body for further use.

I claim:

1. A drill bit comprising a body having boring elements at its lower part and having first releasable connection means for making connection with a drill stem and second releasable connection means for making connection with a gage ring, a gage ring detachably connected to said body, said ring having boring elements at its lower part and including third releasable connection means for making connection with said bit body via said second connection means, said boring elements of the gage ring being disposed radially outwardly from said boring elements of the bit body, the lower part of the bit body whereat the boring elements are disposed being concave and annularly stepped and the lower part of the gage ring whereat the boring elements are disposed providing an outermost annular step axially lower than the other steps, and flow channels across the steps of the bit body, the gage ring extending transversely across the outer ends of said flow channels.

2. Bit according to claim 1 wherein the outer periphery of the ring is substantially full gage and the ring is cemented to the body.

3. Bit according to claim 1 wherein said boring elements of both said body and said ring are tungsten carbide inserts.

4. Bit according to claim 1 wherein the flow channels across the steps of the bit body communicate at their inner ends with flow passage means adjacent the middle part of the bit body.

5. Bit according to claim 4 wherein there are a plurality of flow passages around the outer part of the bit body communicating at their lower ends with the outer parts of said flow channels that extend across the steps of the bit body.

6. Bit according to claim 1 wherein the second and third connection means constitute a rotary shouldered connection when made up, said connection including correlative straight threads and correlative shoulders axially spaced from the threads.

7. Bit according to claim 6 wherein said ring includes a collar extending upwardly beyond said shoulders of the rotary shouldered connection.

8. Bit according to claim 7 wherein said collar is bevelled forming a downwardly flaring conical guide surface.

9. Bit according to claim 8 wherein the outer periphery of the ring is a cylindrical surface and said cylindrical surface and the aforesaid conical guide surface are provided with wear resistant means.

10. A drill bit comprising a body having boring elements at its lower part and having first releasable connection means for making connection with a drill stem and second releasable connection means for making connection with a gage ring, a gage ring detachably connected to said body, said ring having boring elements at its lower part and including third releasable connection means for making connection with said bit body via said said second connection means, said boring elements of the gage ring being disposed radially outwardly from said boring elements of the bit body, the lower part of the bit body whereat the boring elements are disposed being concave and annularly stepped and the lower part of the gage ring whereat the boring elements are disposed provides an outermost annular step axially lower than the other steps, and flow passage means adjacent the middle part of the bit body, flow channels across the steps of the bit body communicating at their inner ends with said flow passage means, and a plurality of flow passages around the outer part of the bit body communicating at their lower ends with the outer parts of said flow channels that extend across the steps of the bit body, said flow channels being radial and said gage ring extending across the outer ends of said channels.

11. A drill bit for percussion drilling comprising a body having an upper part and a lower part with boring elements at the lower part and with first releasable connection means at the upper part for making connection with a drill stem and with second releasable connection means at the lower part for making connection with a gage ring, a gage ring having boring elements at its lower part and including third releasable means for making connection with said bit body via said second connection means and thereby being detachably connected to said bit body with the boring elements of the gage ring being disposed radially outwardly from said boring elements of the bit body, a plurality of fluid passages extending through said bit body between the upper part and the lower part thereof, and flow channels extending across the lower end of said bit body interconnecting said fluid passage means, said gage ring blocking flow from said channels to the outer periphery of the bit.

12. A drill bit for percussion drilling comprising a body having an upper part and a lower part with boring elements at the lower part and with first releasable connection means at the upper part for making connection with a drill stem and with second releasable connection means at its lower part for making connection with a gage ring, a gage ring having boring elements at its lower part and including third releasable means for making connection with said bit body via said second connection means and thereby being detachably connected to said bit body with the boring elements of the gage ring being disposed radially outwardly from said boring elements of the bit body, said second and third connection means constituting a rotary shouldered connection when made up, said connection including a downwardly facing annular shoulder on said body and an upwardly facing correlative annular shoulder on said ring, said connection further including a straight thread on the outer periphery of said lower part of the body below said shoulders spaced axially therefrom by an unthreaded area and a correlative straight thread on the inner periphery of said ring below said shoulders spaced axially therefrom by an unthreaded area, said ring being of larger outer diameter than said body and having an annular lip extending up around said body above said shoulders, said gage ring and said body both having portions extending above and below the juncture of said shoulders.

13. Bit according to claim 12 wherein the lower part of the bit body whereat the boring elements are disposed is concave and annularly stepped and the lower part of the gage ring whereat the boring elements are disposed provides an outermost annular step axially lower than the other steps.

14. Drill bit according to claim 12 further comprising flow passage means extending through the bit from said upper part to said lower part, flow channels extending across the lower part of said bit from said flow passage means to said thread at the outer periphery of said lower part of the body below said shoulders, and flow channel means extending across the lower part of said gage ring from the outer periphery of the ring to said thread at the inner periphery of the ring communicating thereat with said flow channels across the lower part of the body.

* * * * *

UNITED STATES PATENT AND TRADEMARK OFFICE

CERTIFICATE OF CORRECTION

PATENT NO. : 3,982,596

DATED : SEPTEMBER 28, 1976

INVENTOR(S) : VINCENT HUGO VETTER

It is certified that error appears in the above-identified patent and that said Letters Patent are hereby corrected as shown below:

Column 1, line 6, change "use" to -- used --.

Column 2, line 49, change "dsposited" to -- deposited --.

Column 2, line 58, change "protroding" to -- protruding --.

Column 5, line 2, delete the second occurrence of "said".

Signed and Sealed this

Twenty-ninth Day of March 1977

[SEAL]

*Attest:*

RUTH C. MASON
*Attesting Officer*

C. MARSHALL DANN
*Commissioner of Patents and Trademarks*